US009920280B2

(12) United States Patent
Arafat

(10) Patent No.: US 9,920,280 B2
(45) Date of Patent: Mar. 20, 2018

(54) NON-AQUEOUS SILOXANE SOLVENT COMPOSITIONS FOR CLEANING A METAL OR PLASTIC SURFACE

(71) Applicant: El Sayad Arafat, Leonardtown, MD (US)

(72) Inventor: El Sayad Arafat, Leonardtown, MD (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 63 days.

(21) Appl. No.: 15/053,477

(22) Filed: Feb. 25, 2016

(65) Prior Publication Data

US 2017/0247640 A1 Aug. 31, 2017

(51) Int. Cl.

| | |
|---|---|
| ***C11D 3/43*** | (2006.01) |
| ***C11D 9/36*** | (2006.01) |
| ***C11D 3/16*** | (2006.01) |

(52) U.S. Cl.

CPC ..... *C11D 3/162* (2013.01); *C11D 3/43* (2013.01)

(58) Field of Classification Search

CPC ..... C11D 3/0073

See application file for complete search history.

(56) References Cited

U.S. PATENT DOCUMENTS

| | | | | |
|---|---|---|---|---|
| 6,042,617 | A | 3/2000 | Berndt et al. | |
| 7,576,170 | B2 | 8/2009 | Perry | |
| 7,579,495 | B2 | 8/2009 | Perry et al. | |
| 7,897,558 | B1 | 3/2011 | Arafat | |
| 8,273,698 | B2 | 9/2012 | Arafat | |
| 2003/0019048 | A1 | 1/2003 | Perry et al. | |
| 2003/0074742 | A1* | 4/2003 | Perry | D06L 4/15 8/142 |
| 2004/0088795 | A1* | 5/2004 | Orchowski | D06L 1/02 8/142 |
| 2011/0140048 | A1 | 6/2011 | Arafat | |
| 2012/0256303 | A1* | 10/2012 | Meynen | G03F 7/0757 257/632 |

* cited by examiner

*Primary Examiner* — Charles Boyer

(74) *Attorney, Agent, or Firm* — Mark O. Glut; NAWCAD

(57) ABSTRACT

This invention relates to non aqueous non-volatile alkylated siloxane compositions having low VOC and vapor pressure of about 31 millimeters of mercury at 20° C. consisting essentially of a mixture of a linear or open-chain methyl alkylated siloxane having two silicon atoms and a siloxane having three silicon atoms alkylated with methyl groups.

7 Claims, 1 Drawing Sheet

Cleaning Efficiency Test Results for the Selected Commercial Products in Accordance with MIL-PRF-32295A Type III (MIL-G-21164 Soil)
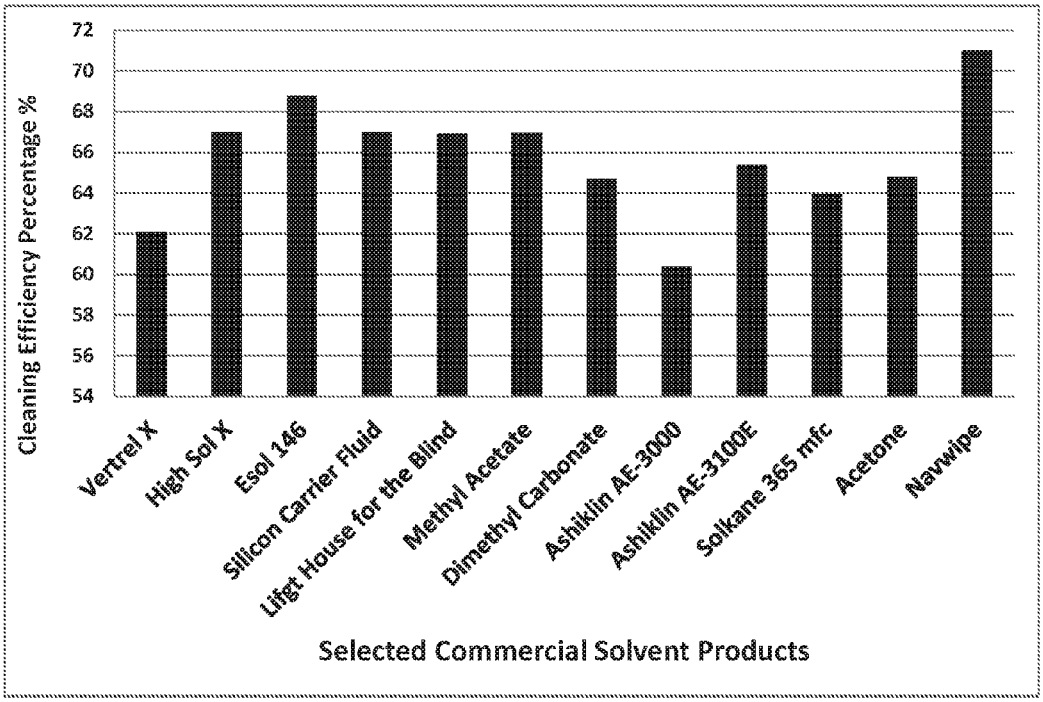

NON-AQUEOUS SILOXANE SOLVENT COMPOSITIONS FOR CLEANING A METAL OR PLASTIC SURFACE

ORIGIN OF INVENTION

The invention described herein was made by employees of the United States Government and may be manufactured and used by or for the Government for governmental purposes without the payment of any royalties thereon or therefor.

FIELD OF THE INVENTION

This invention relates to a unique combination of two alkylated linear siloxanes as a wipe solvent characterized as low-volatile organic or non-volatile organic compositions with vapor pressures of 31 millimeters of mercury at 20° C.

BACKGROUND OF THE INVENTION

Solvent cleaners are known for their excellent cleaning ability, quick drying, metal compatibility, and low surface tension to facilitate penetration. Some solvents are known for the air pollution they cause (as volatile organic compounds or VOC), toxicity, flammability, and incompatibility with plastics. The use of volatile organic compounds (VOC) solvents has been discouraged due to their deleterious effect on the environment. Regulations have been promulgated to accelerate the phase-out of environmentally destructive solvents.

The Environmental Protection Agency ("EPA") promulgates rules and regulations regarding environmental concerns such as VOCs. EPA has defined VOC's to include volatile compounds of carbon which promote atmospheric photo-chemical reactivity. Thus, there is a need to reduce the use of conventional VOC solvents and it is apparent that there is a need for solvents which have little or no VOC content.

The old specification solvent, commonly called Stoddard solvent or mineral spirits, contain petroleum fractions that are complex mixtures of aliphatic hydrocarbons, but may contain some aromatics and olefinics. P-D-680 contains hazardous air pollutants (HAP's) and VOC's and causes health and environmental concerns. The revision to MIL-PRF-680 eliminated the HAP's but MIL-PRF-680 still covers a petroleum-based solvent containing the same amount of VOC's as P-D-680. Since P-D-680 was first written, these solvents have been specified for general cleaning to remove oil and grease from aircraft and engine components and from ground support equipment.

The purpose of this invention is to develop a non-aqueous, low-volatile organic compound (VOC) containing and hazardous air pollutant—(HAP) free cleaner to meet the new environmental regulation in California (Rule 1171). VOCs are released during cleaning operations, contributing to the formation of ground-level ozone (photochemical smog), which can damage lung tissue, cause respiratory illness, and damage vegetation. Solvent emissions are regulated regionally and locally, with the air pollution control districts in California implementing the most stringent requirements. The South Coast Air Quality Management District (SCAQMD) has recently imposed restrictions limiting the VOC content in solvents to no greater than 25 grams per liter for immersion cleaning processes unless the solvent is used in an airtight cleaning system. In addition, under Title III of the 1990 Clean Air Act (CAA) amendment, the U.S. Environmental Protection Agency (EPA) established emissions standards for categories and sub-categories of sources that emit or have the potential to emit listed HAPs.

Wipe solvents are essential for removing contaminants from parts and surfaces before it undergoes manufacturing operations that require clean surfaces, such as painting, sealing, bonding, welding, plating, and other applications. High VOC-containing, high vapor pressure solvents are currently utilized for cleaning aircraft exteriors and parts applications. Currently, most of the products used by the Fleet Readiness Centers (FRCs) for wipe-cleaning applications contain HAPs high VOC contents of greater than 700 g/l. VOCs are released during cleaning operations, contributing to the formation of ground-level ozone (photochemical smog) and causing environmental and health problems. Furthermore, paint thinners, which contain HAP mixtures, are also used for general-purpose hand wipe-cleaning operations as specified in maintenance and corrosion control manuals. Continuing with the use of paint thinners as pre-paint cleaning solvents increases the risk of non-compliance and subsequent fines. Currently, the Navy's NAVAIR 01-1A-509 Cleaning and Corrosion Control manual lists three specifications for wipe-solvent cleaning applications:

1. MIL-T-81772 (Thinner, Aircraft Coating) covers the requirements for three types of thinner to be used in reducing aircraft coatings.
2. AMS 3166 (Solvent Cleaning Prior to Application of Sealing Compounds) is used to clean aircraft primary and secondary structural surfaces prior to application of adhesion promoters and/or sealing materials.
3. ASTM D329 (Acetone) is used for general-purpose hand-wipe cleaning operations. Acetone is an exempt solvent and it is very flammable and it is not compatible with plastics.

The AMS 3166 specification is a Commercial Item Description (CID) and contains only one approved product (Dysol's DS-108). The VOC contents of the DS-108 product is more than 800 g/l and its vapor pressure is as low as 1.1 mmHg. According to NESHAP requirements, the vapor pressure for the wipe solvent cleaners should be around 45 mmHg. None of the MIL-T-81772 qualified products comply with the current environmental regulations (EPA and the SCAQMD). The Material Safety Data Sheet (MSDS) for Acetone (ASTM D329) has shown that Acetone is toxic to central nervous system (CNS). Also, it may be toxic to kidneys, the reproductive system, liver and skin. Repeated or prolonged exposure to Acetone can produce target organ damage. Due to the lack of environmentally-friendly qualified products, the FRCs are using hazardous cleaners such as Desoclean 45 for general-purpose hand-wipe cleaning applications on the F/A-18 aircraft. Because of various EPA Clean Air Act amendments and Resource and Conservation Recovery Act (RCRA) emission restrictions for HAPS/VOC's, along with California's more stringent SCAQMD VOC restrictions, solvents utilized at some aviation facilities cannot be applied for general-purpose wipe-cleaning operations.

BRIEF DESCRIPTION OF THE DRAWINGS

FIG. 1 is a bar graph which shows selected commercial solvent products.

Compositions of the linear or open-chain siloxanes of this invention (Wipe Solvent Formulations) are as follows:

| EXAMPLE 1 | |
|---|---|
| | Parts By Weight |
| Hexamethyldisiloxane | 55 to 75 |
| Octamethyltrisiloxane | 25 to 45 |

| EXAMPLE 2 | |
|---|---|
| Hexamethyldisiloxane | 60 to 70 |
| Octamethyltrisiloxane | 30 to 40 |

| Example 3 | |
|---|---|
| Hexamethyldisiloxane | 62 to 65 |
| Octamethyltrisiloxane | 35 to 38 |

| Example 4 | |
|---|---|
| Hexamethyldisiloxane | 63 (63%) |
| Octamethyltrisiloxane | 37 (37%) |

Properties of the NAVWIPE (Wipe Solvent Formulation)

Several commercial exempt solvents were selected for testing and evaluation for wipe cleaning applications in accordance with the requirements of MIL-PRF-32295A Type III (Table 1). Drying times after cleaning with solvents play an important role in industrial cleaning applications. The drying process depends on several factors such as the vapor pressure of the cleaning solvent, temperature, humidity, and the velocity of the airflow. The Aerospace National Emission Standards for Hazardous Air pollutants (NESHAP) (40 CFR 63 Subpart GG) limits the vapor pressure values for wipe cleaning applications to equal or less than 45 mmHg at 20° C. The vapor pressure of this invention (Navwipe) was determined to be about 31 mmHg at 20° C. as shown in Table 1. Few of the selected commercial products have met NESHAP's vapor pressure requirements for wipe-cleaning applications.

TABLE 1

Comparison of Navwipe with Selected Commercial Solvent Products for Wipe-Cleaning Applications

| Manufacturer | Product | VOC | Vapor Pressure mmHg at 20° C. |
|---|---|---|---|
| DuPont | Vertrel XF | Exempt | 226 |
| Garrett Services, Inc. | High Sol-X | Exempt | NA |
| PPG aerospace PRC-DeSoto | Esol-146 | Exempt | NA |
| Micro Care | Silicon Carrier Fluid | Exempt | 226 |
| Sigma-Aldrich | Acetone | Exempt | 184 |
| Lyondell | Ter-Butyl Acetate | Exempt | 42 |
| NAVAIR Invention | (Navwipe) | Exempt | 31 |
| AGC Chemicals America | Ashiklin AE 3000 | Exempt | 233 |
| AGC Chemicals America | Ashiklin AE 3100E | Exempt | 210 |

TABLE 1-continued

Comparison of Navwipe with Selected Commercial Solvent Products for Wipe-Cleaning Applications

| Manufacturer | Product | VOC | Vapor Pressure mmHg at 20° C. |
|---|---|---|---|
| Kowa American Corp. | Dimethyl Carbonate | Exempt | 55 |

Effect on Plastics (Crazing Test)

The effect of the siloxane composition and selected commercial products on plastics was studied in accordance with ASTM F 484. The plastic materials used for this test are listed below:

a. MIL-PRF-5425 cast acrylic (annealed in accordance with ASTM F 484)
b. MIL-PRF-25690 stretch acrylic
c. SAE AMS-P-83310 polycarbonate The specimens were secured in the loading fixture. The product was applied onto the top surface of the plastic by spraying back and forth three times in ten seconds from a distance of six inches. The test coupons were allowed to air dry for one hour and then were examined for crazing and strength loss. Crazing is evident when a flashlight is used to illuminate the specimen from a direction tangent to the specimen bend. Strength loss is evident if, when removed from the fixture, it fails easily when bent by hand. The results of the crazing test for the selected commercial products and the new invention on the cast acrylic plastic are shown in Table 2. All tested products failed the crazing test with the exception of the siloxane composition of this invention, (Navwipe) which met the requirement. In addition, the siloxane composition (Navwipe) passed the test requirements of stretch acrylic and polycarbonate materials.

TABLE 2

Compatibility of Selected Commercial Products on Plastics (Crazing Test: ASTM F 484)

| Product | Cast Acrylic MIL-PRF-5425 |
|---|---|
| High Sol-X | Fail |
| Esol 146 | Fail |
| Dimethyl Carbonate | Fail |
| Acetone | Fail |
| Ashiklin 3100E | Fail |
| Ashiklin 3000 | Fail |
| Ter-Butyl Acetate | Fail |
| Navwipe | PASS |

The cleaning efficiency test for Navwipe cleaner was conducted in accordance with test method 4.5.9 in MIL-PRF-32295A Type III as described below.

Preparation of test specimens: Stainless steel coupons of 1 by 2 by 0.05 inches (25 by 50 by 1.3 mm) were polished with 240-grit aluminum oxide abrasive paper or cloth and solvent wiped with isopropyl alcohol. Coupons were weighed (weight=W1), coated on one side with 20-25 mg of soil, then reweighed (weight=W2). Soils used for testing were the following:

a. MIL-G-21164 (Grease, Molybdenum Disulfide, for Low and High Temperatures)
b. MIL-PRF-83282 (Hydraulic Fluid, Fire Resistant, Synthetic Hydrocarbon Base)
c. MIL-PRF-10924 (Grease, Automotive and Artillery)

Test Procedure.

Fresh solvent was used for each soil tested. Each test coupon was cyclically immersed and withdrawn from a 150-ml beaker containing 100 ml of the cleaner at a rate of 20 cycles per minute for 5 minutes. Each coupon dried for 10 minutes at 140±4° F. (60±2° C.), cooled to room temperature, and reweighed (weight=W3). Cleaning efficiency for the cleaner was calculated as follows for each coupon:

$$\% \text{ Cleaning Efficiency}=(W2-W3)/(W2-W1)\times 100$$

The cleaning efficiency of the siloxane composition (Navwipe) was conducted in accordance with the requirements of MIL-PRF-32295A Type III and the results are shown in Table 3. In addition, the results of cleaning efficiency of the selected products on one soil (MIL-G-21164) are shown in Table 4. As shown in FIG. 1, the results indicate that the siloxane compositions of this invention (Navwipe) is the only product that meets the requirements of MIL-PRF-32295A Type III.

TABLE 3

Cleaning Efficiency Test Results for a. Siloxane Composition (Navwipe)

| Soil | Product: MIL-PRF-32295A Type III Requirements | Product: New Invention (Navwipe) |
|---|---|---|
| MIL-G-21164 | 70% | 71% |
| MIL-PRF-10924 | 85% | 96% |
| MIL-PRF-83282 | 95% | 97% |

TABLE 4

Cleaning Efficiency Test Results for the Selected Commercial Products in Accordance with MIL-PRF-32295A Type III (MIL-G-21164 Soil)

| Product | Cleaning Efficiency Percentage (%) (MIL-G-21164 Soil) |
|---|---|
| Vertrel-XF | 62.1 |
| High Sol-X | 67.0 |
| Esol 146 | 68.8 |
| Silicon Carrier Fluid | 67.0 |
| LHB | 66.95 |
| Methyl Acetate | 66.97 |
| Dimethyl Carbonate | 64.70 |
| Ashiklin AE-3100E | 65.40 |
| Ashiklin AE-3000 | 60.40 |
| Solkane 365 mfc | 63.95 |
| Acetone | 64.80 |
| Siloxanes (Navwipe) | 71.00 |

The specific siloxanes of this invention consist essentially of linear or open-chain alternating silicon and oxygen atoms wherein the prefix denotes the number of silicon atoms alkylated with methyl groups. It was found that the di and trisiloxane mixtures alkylated with alkyl methyl groups (Navwipe) were the only products that met the requirements of MIL-PRF-32295A Type III as shown by the data in Table 3 and FIG. 1.

The benefits of the siloxane compositions of this invention are providing the fleet with effective, safe, environmentally-friendly wipe-solvent cleaner. Providing qualified cleaners to all levels of maintenance will avoid risk of use of improper materials, which may compromise performance, safety and health. In addition, the outcomes of this invention are improving the fleet readiness, and pollution prevention onboard ships and complying with the current environmental regulations. To meet the new environmental regulations, it is essential to identify and validate effective, safe, and environmentally friendly products for cleaning applications. The Navwipe will be used to clean weapon systems across Department of Defense (DOD) maintenance facilities as alternatives to the current high VOC products. The advantages of the Navwipe cleaner include:

- Exempt Solvent,
- Odorless properties,
- Free of HAPs,
- Compatible with metals and non-metals,
- Non-toxic,
- Dry fast,
- Contains no ozone-depleting substances (ODSs),
- Cleaning efficiency is equivalent to the high VOC control,
- Complies with EPA and the new environmental regulations,
- A new alternative for high VOC commercial products, and
- Provides a safer and environmentally friendly cleaner to the fleet.

The siloxane composition (Navwipe) will be used for cleaning aircraft structure (metal and composite) surfaces prior to painting, sealing, bonding, application of adhesion promoters. In addition, the Navwipe will be used as a replacement for hazardous chemicals currently used by the fleet such as methyl ethyl ketone (MEK) and methyl isobutyl ketone (MIBK), and MIL-T-81772 for wipe-cleaning applications.

While various embodiments of the invention have been disclosed, the specific composition and methods described herein are not intended to limit the scope of the invention.

The invention claimed:

1. A process for removing and cleaning oleaginous materials from a metal surface which comprises adding an effective amount of a siloxane composition onto said oleaginous-containing metal surface and subsequently cleaning the oleaginous material from the metal surface; said siloxane composition having a low VOC and a vapor pressure of about 31 millimeters of mercury at about 20° C. and consists essentially of from about 55 to 75 parts by weight of an alkylated open-chain siloxane having two silicon atoms and from about 25 to 45 parts by weight of an alkylated open-chain siloxane having three silicon atoms.

2. The process of claim 1 wherein the siloxane having two silicone atoms is hexamethyldisiloxane and the siloxane having three atoms is octamethyltrisiloxane.

3. The process of claim 2 wherein the hexamethyldisiloxane is present in the siloxane composition in an amount ranging from about 60 to 70 parts by weight and the octamethyltrisiloxane is present in the siloxane composition in an amount ranging from about 30 to 40 parts by weight.

4. The process of claim 2 wherein the hexamethyldisiloxane is present in the siloxane composition in the amount of about 63 parts by weight and the octamethyltrisiloxane is present in the siloxane composition in the amount of about 37 parts by weight.

5. A process for removing and cleaning oleaginous materials from a plastic surface which comprises adding an effective amount of a siloxane composition onto said oleaginous-containing plastic surface and subsequently cleaning the oleaginous material from the plastic surface; said siloxane composition having a low VOC and a vapor pressure of about 31 millimeters of mercury at about 20° C. and consists essentially of from about 55 to 75 parts by weight of an alkylated open-chain siloxane having two silicon atoms and from about 25 to 45 parts by weight of an alkylated open-chain siloxane having three atoms.

6. The process of claim 5 wherein the siloxane having two silicon atoms is hexamethyldisiloxane and the siloxane having three atoms is octamethyltrisiloxane.

7. The process of claim 5 wherein the hexamethyldisiloxane is present in the siloxane composition in an amount ranging from about 60 to 70 parts by weight and the octamethyltrisiloxane is present in the siloxane composition in an amount ranging from about 30 to 40 parts by weight.

* * * * *